US010378826B2

(12) United States Patent
Nelson et al.

(10) Patent No.: US 10,378,826 B2
(45) Date of Patent: Aug. 13, 2019

(54) HEAT EXCHANGER

(71) Applicants: Bruce Ian Nelson, Colville, WA (US); Chad W. Meyers, Colville, WA (US); James A. Phelan, Cissna Park, IL (US)

(72) Inventors: Bruce Ian Nelson, Colville, WA (US); Chad W. Meyers, Colville, WA (US); James A. Phelan, Cissna Park, IL (US)

(73) Assignee: Colmac Coil Manufacturing, Inc., Colville, WA (US)

( * ) Notice: Subject to any disclaimer, the term of this patent is extended or adjusted under 35 U.S.C. 154(b) by 64 days.

(21) Appl. No.: 15/293,500

(22) Filed: Oct. 14, 2016

(65) Prior Publication Data

US 2018/0106550 A1 Apr. 19, 2018

(51) Int. Cl.

| | |
|---|---|
| ***F28F 7/00*** | (2006.01) |
| ***F28D 7/00*** | (2006.01) |
| ***F28D 7/02*** | (2006.01) |
| ***F28D 7/10*** | (2006.01) |
| ***F28F 9/02*** | (2006.01) |
| ***F25B 39/02*** | (2006.01) |

(Continued)

(52) U.S. Cl.

CPC ..... *F28D 7/103* (2013.01); *F25B 39/028* (2013.01); *F25B 39/04* (2013.01); *F28D 7/024* (2013.01); *F28F 9/028* (2013.01); *F28F 9/0243* (2013.01); *F28F 9/0263* (2013.01); *F25B 7/00* (2013.01); *F25B 2339/0242* (2013.01); *F28D 2021/007* (2013.01); *F28D 2021/0071* (2013.01); *F28F 2009/029* (2013.01); *F28F 2210/08* (2013.01); *F28F 2265/16* (2013.01); *F28F 2265/26* (2013.01)

(58) Field of Classification Search

CPC . F28D 7/02; F28D 7/024; F28D 7/026; F28D 7/04

USPC ..... 165/139, 160, 159, 163

See application file for complete search history.

(56) References Cited

U.S. PATENT DOCUMENTS 1,768,222 A * 6/1930 Uhde ..... F22G 1/005 165/163

2,468,903 A * 5/1949 Villiger ..... F28D 7/1669 122/511

(Continued)

FOREIGN PATENT DOCUMENTS

GB 1163804 A 9/1969

OTHER PUBLICATIONS

Notification of Transmittal of the International Search Report and the Written Opinion of the International Searching Authority, or the Declaration, PCT/US2017/042828, Sep. 27, 2017.

*Primary Examiner* — Jason N Thompson

(74) *Attorney, Agent, or Firm* — Randall Danskin P.S.

(57) ABSTRACT

A heat exchanger is described and which includes an exterior container having an internal cavity; a refrigerant distribution tube is positioned within the internal cavity and which is further coupled in fluid receiving relation relative to a first source of refrigerant; and a multiplicity of closely nested refrigerant tubes are located within the internal cavity and are further disposed in a closely spaced, radially outwardly oriented positions relative to the refrigerant distribution tube, and which additionally have a predetermined and similar length dimension, and individually form helical coils which have a given and similar length dimension, and a variable pitch, and which are further coupled to a second source of a refrigerant.

7 Claims, 4 Drawing Sheets

(51) Int. Cl.

| | |
|---|---|
| ***F25B 39/04*** | (2006.01) |
| *F28D 21/00* | (2006.01) |
| *F25B 7/00* | (2006.01) |

(56) References Cited

U.S. PATENT DOCUMENTS

| | | | | |
|---|---|---|---|---|
| 3,332,478 | A * | 7/1967 | Saunders | F24D 3/082 165/163 |
| 6,102,106 | A | 8/2000 | Manning et al. | |
| 6,679,083 | B1 * | 1/2004 | Erickson | F25B 37/00 62/476 |
| 7,131,489 | B2 * | 11/2006 | Gohna | F28D 7/1607 165/161 |
| 7,377,307 | B1 * | 5/2008 | Ijiri | F28D 7/16 165/100 |
| 7,594,536 | B2 * | 9/2009 | Sugihara | F28D 7/16 123/568.12 |
| 2003/0111209 | A1 * | 6/2003 | Tsujita | F28D 7/1653 165/51 |
| 2008/0149317 | A1 | 6/2008 | Baker | |
| 2013/0139541 | A1 * | 6/2013 | Seybold | F28D 7/10 62/498 |
| 2017/0000653 | A9 | 1/2017 | Kameda et al. | |

* cited by examiner 71
72
73
74
75
76
77
78
70
90
91
92
92A
93
94
95
96
97
200

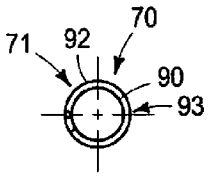
FIG. 3A1
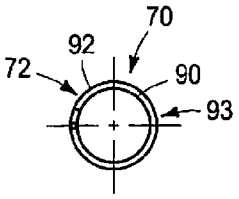
FIG. 3B1
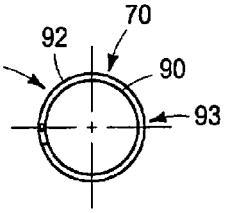
FIG. 3C1
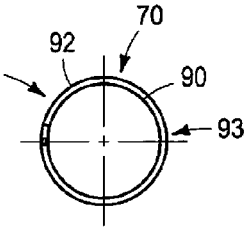
FIG. 3D1
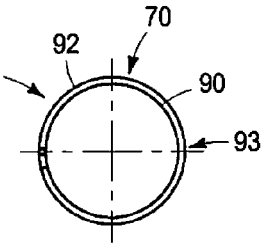
FIG. 3E1
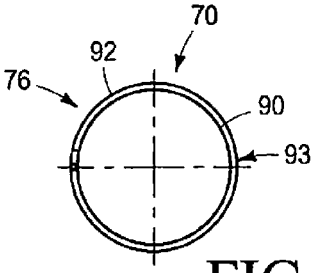
FIG. 3F1
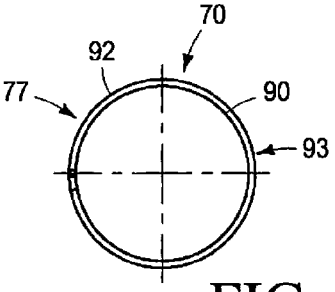
FIG. 3G1
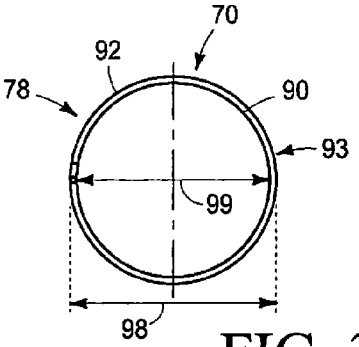
FIG. 3H1

HEAT EXCHANGER

TECHNICAL FIELD

The present invention relates to a heat exchanger which finds usefulness in cascade refrigeration systems.

BACKGROUND OF THE INVENTION

A cascade heat exchanger as used in a refrigeration system has traditionally been either "shell and tube" or "plate" type in construction. Typical "shell and tube" heat exchangers have a multiplicity of straight tubes which are expanded into opposing tube sheets that are contained within a cylindrical shell. Because of this style of construction, the tubes are held rigidly between the tube sheets and consequently, high axial strain, stresses, and other forces, can occur during relatively large changes in temperature and pressure of the refrigerant which is being utilized. Under these circumstances if the strain and accompanying stresses reaches a high enough value the individual tubes may crack and rupture resulting in cross-contamination of the two refrigerants which are being employed. This may result in damage to the overall refrigeration system.

Shell and tube heat exchangers occupy a relatively large spatial volume for a given heat transfer duty, and is therefore not considered a "compact" heat exchanger. Plate heat exchangers, on the other hand, can be made in a "plate and shell" or a "plate and frame"; or in a "welded plate" configuration. All of the aforementioned forms of the prior art include a stack or multiple of formed plates, having a manifold system which distributes the two refrigerants, being employed, alternatively, between the plates such that one of the refrigerants flows on one side of each of the plates, while the other refrigerant flows on the opposite side of the respective plate. These plate heat exchangers are considered to be "compact," but because the plates are held rigidly in a given spatial relationship, one relative to the other, high strains and stresses can form in the plate material when the heat exchanger is exposed to large changes in temperature and pressure of the respective refrigerants.

Ultimately, acceptable performance of any form of a prior art cascade heat exchanger depends largely upon uniform flow distribution of both refrigerants within multiple tubes or plates. This uniform flow distribution is typically difficult to achieve with conventional "shell and tube" and "plate" type heat exchangers under two phase flow conditions (that is condensing or evaporating) of the refrigerants.

While the aforementioned prior art cascade heat exchangers have operated with varying degrees of success, problems still remain in their use when deployed in various environments. Chief among the problems exhibited by these prior art devices include the frequent failure of these prior art designs due to the excessively high strain and stress experienced by the tubes and plates as mentioned, above. Still further, these prior art cascade heat exchangers have a very high cost of construction. Moreover, and as mentioned briefly above, these prior art cascade heat exchangers often present a situation where the non-uniform distribution of a two-phase refrigerant flow to multiple circuits or passages within the prior art devices results in relatively poor heat transfer performance. Still further these prior art cascade heat exchangers often have large internal volume and space requirements which is the case for the shell and tube type construction as mentioned, above. Finally, the prior art devices appear to uniformly prevent the reversing of the two refrigerants for purposes of defrosting the prior art device.

Therefore, a heat exchanger which avoids the problems associated with the prior art devices utilized, heretofore, is the subject matter of the present invention.

SUMMARY OF THE INVENTION

A first aspect of the present invention relates to a heat exchanger which includes an exterior container which defines an internal cavity; a refrigerant distribution tube which is positioned within the internal cavity, and which is further coupled in fluid receiving relation relative to a first source of refrigerant; and a multiplicity of closely nested, refrigerant tubes which are located within the internal cavity of the exterior container, and which are further disposed in closely spaced, radially outwardly oriented positions relative to the refrigerant distribution tube, and wherein the respective refrigerant tubes each have a predetermined length dimension, and individually form a helical coil which has a given length dimension, and pitch, and wherein each of the refrigerant tubes, and the respective helical coils that the individual refrigerant tube forms have the same length dimension, and wherein the respective refrigerant tubes are each coupled in fluid receiving relation relative to a second source of a refrigerant.

Still another aspect of the present invention relates to a heat exchanger which includes an exterior container which has opposite, first and second ends, and which further defines an internal cavity, and wherein the exterior container is further defined by a longitudinal axis which extends between the first and second ends thereof; a refrigerant distribution tube which is positioned within the internal cavity of the exterior shell, and which is further oriented along the longitudinal axis thereof, and wherein the refrigerant distribution tube has a first refrigerant intake end which is located within the internal cavity, and in spaced relation relative to the first end of the exterior container, and a second refrigerant exhaust end, and wherein the second refrigerant exhaust end is located within the internal cavity of the exterior shell, and in spaced relation relative to the second end of the exterior container, and wherein the first end of the refrigerant distribution tube is fluid flowingly coupled to a source of a first refrigerant; and a multiplicity of refrigerant tubes which are received within the internal cavity of the exterior container, and which each have an equal length dimension, and wherein each refrigerant tube further defines a helically shaped coil having a coil length, and wherein each helical coil is substantially of equal length, and wherein the respective refrigerant tubes are further individually located in a radially outwardly spaced relationship relative to the longitudinal axis thereof, and wherein the respective helical coils defined by each of the refrigerant tubes are either left-handed, or right-handed in orientation, and are further nested together, in both a longitudinal and a radially outward direction, so as to orient the respective refrigerant tubes in a predetermined, closely spaced relationship which occupies a preponderance of the internal cavity of the exterior container, and wherein the respective refrigerant tubes each have a first intake end, and a second exhaust end, and wherein the first end of the respective refrigerant tubes are further fluid flowing coupled to a second source of a refrigerant, and the second end of the refrigerant tubes is disposed in fluid flowing communication with the second end of the external container.

These and other aspects of the present invention we discuss in greater detail hereinafter.

BRIEF DESCRIPTIONS OF THE DRAWINGS

Preferred embodiments of the invention are described below with reference to the following accompanying drawing.

Figure 1:
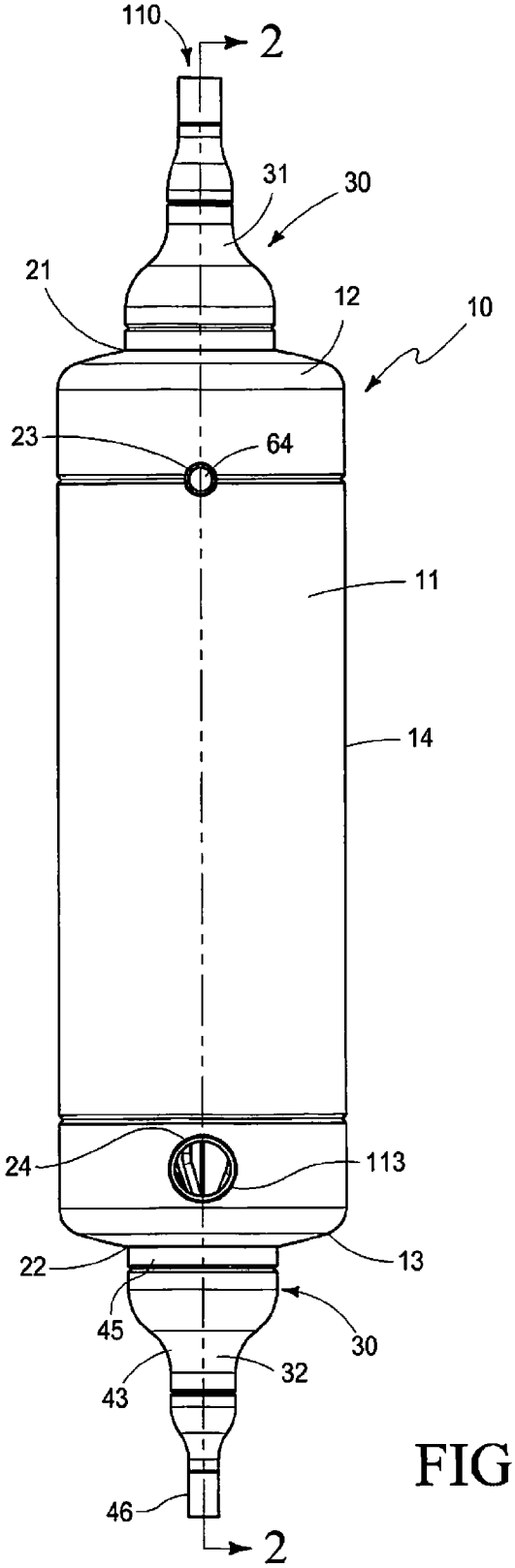
FIG. 1 is a perspective, side elevation view of the heat exchanger of the present invention.
Figures 3A, 3B, 3C, 3D, 3E, 3F, 3G, 3H:
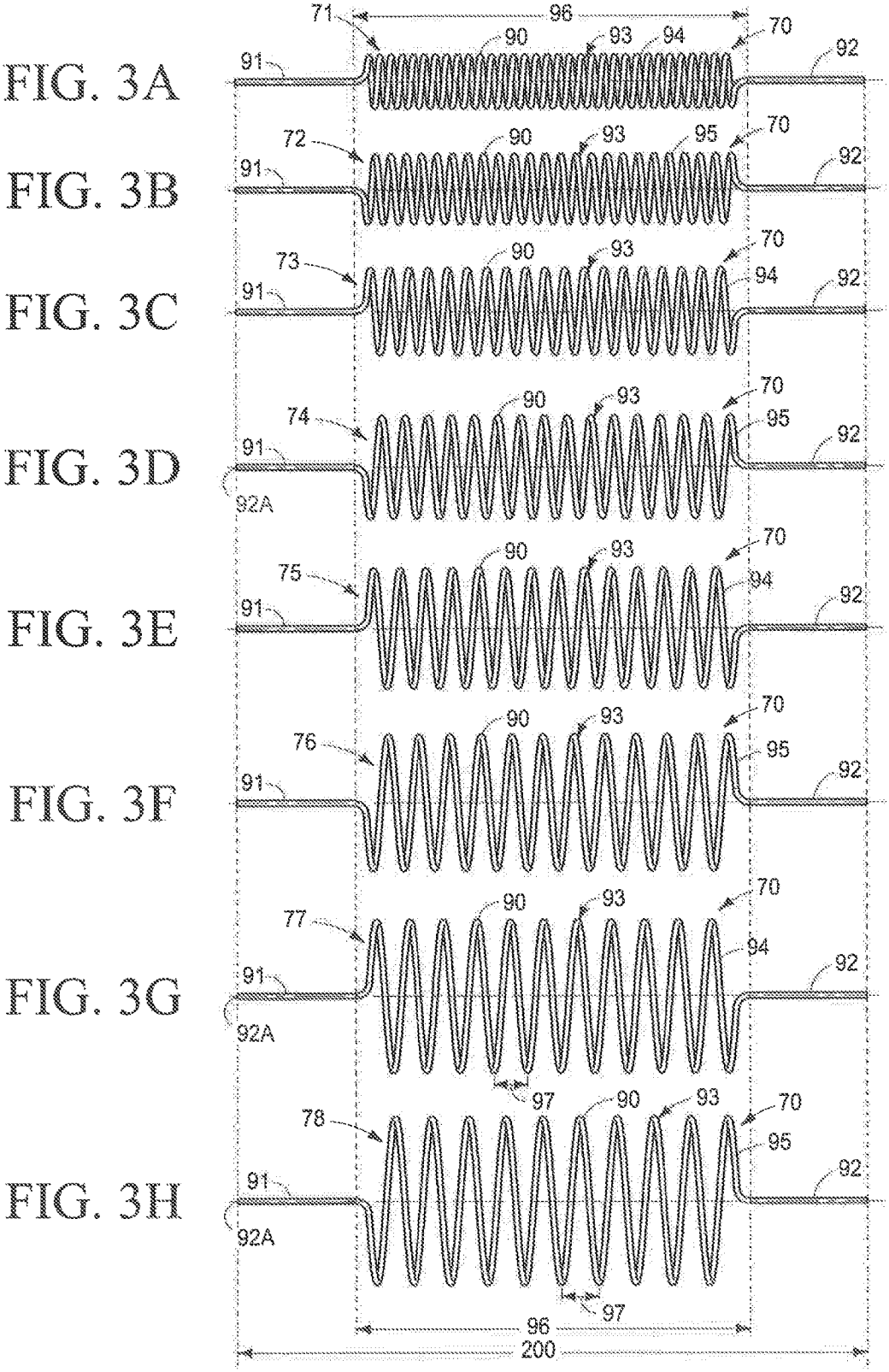
FIG. 3A is a side elevation view of a first form of a refrigerant tube finding usefulness in the present invention, and which defines a helical coil which is left handed.

FIG. 3A1 is an end view of the refrigerant tube which is seen in FIG. 3A.

FIG. 3B is a side elevation view of a second form of a refrigerant tube finding usefulness in the present invention, and which defines a helical coil which is right handed.

FIG. 3B1 is an end view of the refrigerant tube as seen in FIG. 3B.

FIG. 3C is a side elevation view of a third form of a refrigerant tube finding usefulness in the present invention, and which defines a helical coil which is left handed.

FIG. 3C1 is an end view of the refrigerant tube as seen in FIG. 3C.

FIG. 3D is a side elevation view of a fourth form of a refrigerant tube finding usefulness in the present invention, and which defines a helical coil which is right handed.

FIG. 3D1 is an end view of the refrigerant tube as seen in FIG. 3D.

FIG. 3E is a side elevation view of a fifth form of a refrigerant tube finding usefulness in the present invention, and which defines a helical coil which is left handed.

FIG. 3E1 is an end view of the refrigerant tube as seen in FIG. 3E.

FIG. 3F is a side elevation view of a sixth form of a refrigerant tube finding usefulness in the present invention, and which defines a helical coil which is right handed.

FIG. 3F1 is an end view of the refrigerant tube as seen in FIG. 3F.

FIG. 3G is a side elevation view of a seventh form of a refrigerant tube finding usefulness in the present invention, and which defines a helical coil which is left handed.

FIG. 3G1 is an end view of the refrigerant tube as seen in FIG. 3G.

FIG. 3H is a side elevation view of an eighth form of a refrigerant tube finding usefulness in the present invention, and which defines a helical coil which is right handed.

FIG. 3H1 is an end view of the refrigerant tube as seen in FIG. 3H.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 2:
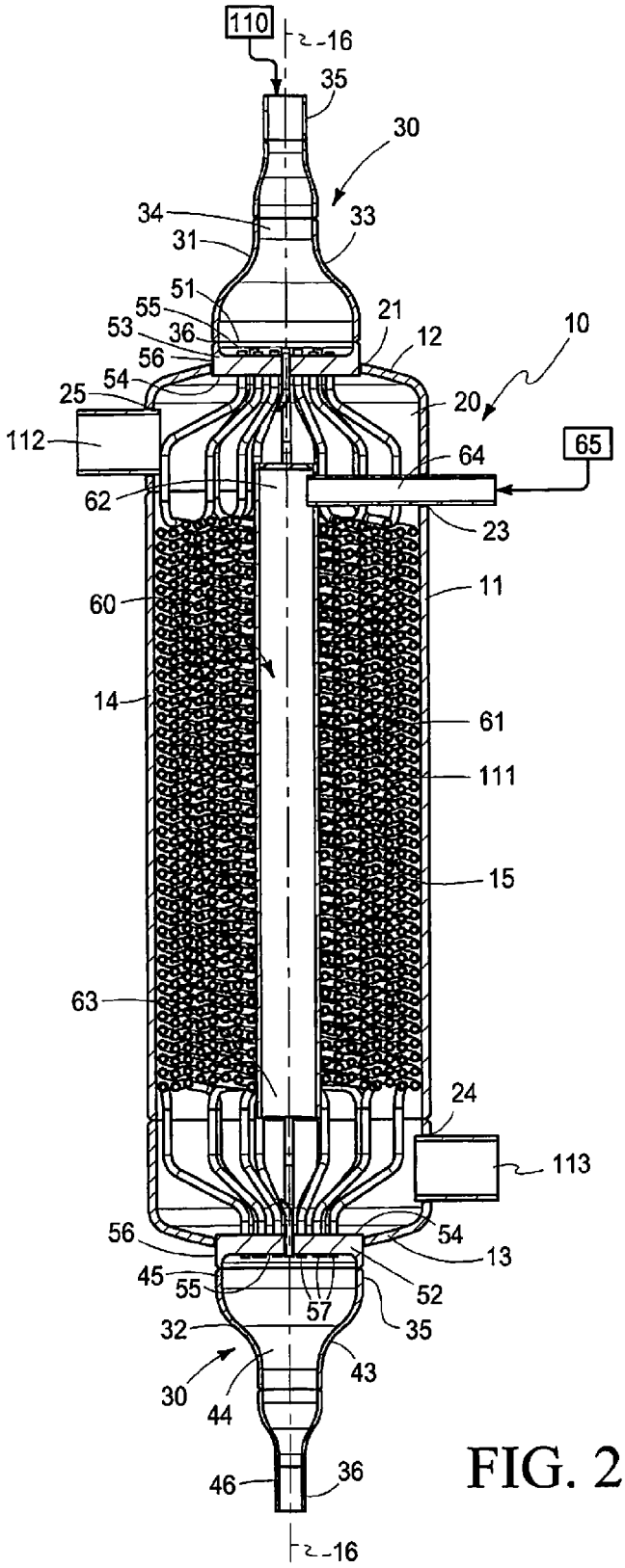
FIG. 2 is a longitudinal, vertical, sectional view of the present invention and which is taken from a position along line 2-2 of FIG. 1.

The present invention is generally indicated by the numeral 10 in FIGS. 1 and 2, respectively. The heat exchanger 10 is defined, at least in part, by an exterior container 11 which is herein illustrated as being cylindrically shaped, and which has a first end 12, and an opposite, second end 13. The exterior container 11 is defined by an exterior facing sidewall surface 14, and an opposite, interior facing sidewall surface 15. Still further the exterior container 11 has a longitudinal axis 16 which extends between the first and second ends 12 and 13. The exterior container 11 includes an internal cavity 20 which is defined, at least in part, by the interior facing sidewall surface 15. The internal cavity has a given transverse cross-sectional dimension, and area, which defines, at least in part, a flow area which will be discussed in greater detail, hereinafter. The first end 12 of the exterior container defines a first aperture 21 which extends therethrough, and which further communicates with the internal cavity 20. Similarly, the second end 13 of the exterior container 11 defines a second aperture 22 which also communicates with the internal cavity 20. First, second and third sidewall apertures 23, 24 and 25 are formed in the exterior container 11 and allow communication to the internal cavity 20 of the exterior container 11.

Referring now to FIGS. 1 and 2, the present invention 10 includes a pair of refrigerant couplers which are generally indicated by the numeral 30, and which are further located at the opposite, first and second ends 12 and 13 of the exterior container 11. The respective refrigerant couplers 30 include a first refrigerant delivery coupler which is generally indicated by the numeral 31; and a second, refrigerant removal coupler 32. The respective refrigerant couplers 30 are coupled or mounted in occluding, fluid flowing relation relative to the respective first and second apertures 12 and 13, and which are formed in or defined by the first and second ends 12 and 13, of the exterior container 11. The first refrigerant delivery coupler 31 has a somewhat bell shaped main body 33. The main body 33 defines an internal cavity 34 which has a variable cross sectional dimension. The main body 33 has a first intake end 35, and a second, exhaust end 36 which is coupled in fluid delivering relation relative to the first end 12 of the exterior container 11. The second refrigerant removal coupler 32 appears in some respects to have similar construction, but operates somewhat differently from the first refrigerant delivery coupler 31. In this regard, the second refrigerant removal coupler 32 has a main body 43 having a similar shape when compared to first refrigerant delivery coupler 31. Still further, the main body 43 has or defines an internal cavity 44 having a variable cross-sectional dimension. The main body 43 has a first, intake end 45 which is sealably coupled in fluid receiving relation relative to the second end 13 of the exterior container 11, and which further occludes the second aperture 22. The main body 43 additionally has a second, exhaust end 46 opposite to the first intake end 45.

Referring again to FIG. 2, the present invention 10 includes first and second refrigerant distribution plates 51 and 52 and which are individually placed in a substantially occluding relationship relative to the first and second apertures 21 and 22, respectively. The first and second refrigerant distribution plates are substantially circular in shape, and have a main body 53 which is defined by a first and second surface 54 and 55. The first and second surfaces are substantially planar, and are further disposed in spaced relation one relative to the other. The main body 53 of the respective first and second refrigerant distribution plates 51 and 52 is also defined, at least in part, by a peripheral edge 56. The main body 53 has formed therein a multiplicity of spaced apertures 57 which are utilized to receive, and fluid sealably couple to individual refrigerant tubes which will be discussed in greater detail, hereinafter. The respective spaced apertures 57 are formed in a predetermined pattern for the purposes which will be set forth in greater detail, below. The main body 53 is also sealably coupled or otherwise affixed to one end of the respective refrigerant couplers 30 as seen in the drawings.

The present invention 10 includes an elongated refrigerant distribution tube 60, which is positioned within the internal cavity 20 as defined by the exterior container 11. The refrigerant distribution tube is positioned substantially along, and is coaxially aligned relative to the longitudinal axis 16 of the exterior container 11 as seen in FIG. 2. The refrigerant distribution tube has a main body 61 which has a predetermined length dimension, and which is less than the length dimension of the exterior container 11. The main body 61 has a first end 62, which is positioned in inwardly spaced relation relative to the first end 12 of the exterior container, and is further located within the internal cavity 20 thereof; and an opposite second end 63, and which is located in predetermined spaced relation relative to the second end 13 of the exterior container 11. The first end 62 of the main body is coupled to a conduit 64 which extends generally radially outwardly therefrom, and further is received, and passes through the aperture 23, and which is formed in the exterior container 11. The conduit 64 is coupled in fluid receiving relation relative to a first source of a low pressure refrigerant, and which is generally indicated by the numeral 65, and which is further delivered to the conduit 64. The conduit 64 consequently delivers the low pressure refrigerant 65 to the first end 62 of the main body 61. The first source of the low pressure refrigerant 65 then travels along the main body 61, from the first end 62, to the second end 63, and where the low pressure refrigerant 65 is then released into the internal cavity 20 as defined by the exterior container 11. The low pressure refrigerant has a pressure range of about 5 PSI [A] to about 315 PSI[A]. An exemplary first source of a low pressure refrigerant 65 comprises ammonia which, when used in a cooling operation, evaporates upon exiting the second end 63 for the purposes which will be described, hereinafter. Other useful low pressure refrigerants include, but are not limited to, halocarbons refrigerants, and hydrocarbon refrigerants, respectively.

As seen in FIG. 2 and following, a multiplicity of closely nested, refrigerant tubes 70 are located within the internal cavity 20 of the exterior container 11. These refrigerant tubes are disposed in closely spaced, radially outwardly oriented positions relative to the refrigerant distribution tube 60, and further occupy a majority of cross sectional area or space defined by the internal cavity 20. The multiplicity of closely nested refrigerant tubes 70 include first, second, third, fourth, fifth, sixth, seventh and eighth forms, and which are generally indicated by the numerals 71 through 78 respectively, and which further are seen in FIGS. 3A through 3H; and FIGS. 3A1 through FIG. 3H1, respectively. The respective refrigerant tubes 70 each are defined by a main body 90 which has a first end 91, and a second end 92 with a length dimension 200 therebetween. Each main body 90 has an identical outside diametral dimension, and further defines a fluid passageway 92A which extends between the first and second end 91 and 92. The fluid passageway 92A has a similar or identical inside diametral dimension. The main body 90 of each form is fabricated of a metal tube which has the same length dimension 200 when measured between the first and second ends 91 and 92. This feature that each refrigerant tube 20 be identical in length 200 to each of the other refrigerant tubes 20, is an important operational aspect of the present invention 10. This feature will be discussed at greater length, below. Further, the main body 90 is formed, at least in part, into a helical coil 93. The helical coil of the respective forms, 71-78, while having a similar overall length dimension 96, have different characteristics, as set forth below. In this regard, the helical coil 93 may take on the form of a left-handed coil which is generally indicated by the numeral 94, or a right-handed coil which is generally indicated by the numeral 95. With regard to the definition of a left-handed or right-handed helical coil it should be understood that if a helix is held, and one was to look along a line of sight which is directed along the helix axis, if a clockwise screwing motion moves the helix away from the observer, the helix form is considered a right-hand helix. On the other hand, if the same clockwise rotation of a helix moves the helix towards the observer then this helix form is considered a left-hand helix. Left or right handedness, or chirality, is a property of the helix, and not that, of the perspective. For example, a right-handed helix cannot be turned to look like a left-handed one unless it is viewed in a mirror and vice versa. Further each helix has a pitch 97. The eight forms 71-78 each have individually discrete pitches 97. A pitch for purpose of this application is defined as the height of one complete helix turn when it is measured parallel to the axis of the helix. In the present invention 10, the helical coil length which is indicated by the line 96 for each of the forms of the refrigerant tubes 71 through 78 respectively, remains identical, while the pitch 97 as well as the outside diameter and inside diametral dimension 98 and 99 of the helical coil 93, respectively, vary for the several forms 71-78 of the refrigerant tubes 70. The variation of the left handed and right handed nature 94 and 95 of the helical coil 93, as well as a variation of the pitch 97, and outside diameter 98 of the respective helical coils 93 allows a multiplicity of refrigerant tubes 70, (23 as seen in the form of the invention as seen in FIG. 2), to be closely nested in a closely packed, yet slightly spaced orientation within the internal cavity 20 of the exterior container 11 so as to achieve the refrigeration benefits that are discussed in greater detail, below. At least one pair of helical coils 93 are arranged in a double helix configuration wherein the helical coils are coaxially screwed together, and the axis of each of the helical coils 93 arranged in the double helix configuration that are coaxially screwed together is coaxially aligned with the refrigerant distribution tube 20.

Referring now to FIG. 3A the first form 71, of the refrigerant tube 70, and which has the characteristics as noted, above, is illustrated. In the construction as seen in FIG. 2, only one refrigerant tube 70 having this construction, or shape, is employed, and is further positioned within the internal cavity 20. The pitch 97 of the first form 71 of the refrigerant tube 70 is equal to about 1.2 to about 2.0 times the outside diametral dimension of the refrigerant tube 70. The first form 71 further is left-handed 94 in orientation, and additionally has an inside diametral dimension 99 which is sized so as to telescopingly receive, and be radially spaced outwardly from, the refrigerant distribution tube 60. The outside diametral dimension 98 of the first form 71 allows it to be telescopingly and coaxially received within the second form 72, of the refrigerant tube 70, as see in FIG. 3B. As should be understood, the second form 72 of the refrigerant tube 70 is right handed 95, and in the construction as seen in FIG. 2, two of the refrigerant tubes having the form 72 are coaxially screwed together and are then installed in the internal cavity 20 at a location which is radially, outwardly, relative to the first form 71 of the refrigerant tube 70. The pitch 97 of the second form 72 of the refrigerant tube 70 is equal to about 2.4 to 4.0 times the outside diametral dimension of the refrigerant tube 70. The second form 72 of the refrigerant tube 70 has an outside coil diameter 98 which permits it to be telescopingly received within the inside diametral dimension 99 of the third form 73, of the refrigerant tube 70 (FIG. 3C). In the construction as seen in FIG. 2, two refrigerant tubes having the shape of the third form 73, and which are both of left-handed 94, are coaxially screwed together. The pitch 97 of the third form 73 is equal to about 2.4 to about 4.0 times the outside diametral dimension of the refrigerant tube 70. Referring now to FIG. 3D, the fourth form 74, of the refrigerant tube 70 is shown. The fourth form 74 has an inside diametral dimension 99 which allows the third form 73 to be telescopingly and coaxially received therein. In the present design, three of the refrigerant tubes 70 having the shape of the fourth form 74, and which are each right-handed 95, are coaxially screwed together. The pitch 97 of the fourth form 74 of the refrigerant tubes 70 is equal to about 3.6 to about 6 times the outside diametral dimension of the refrigerant tube 70. A fifth form 75 of the refrigerant tubes 70 is seen in FIG. 3E. The fifth form 75, which is left-handed 94, has an inside diametral dimension 99 which is sized so as to telescopingly receive the fourth form 74, therein. In the present construction as seen in FIG. 2, 3 left handed 94 refrigerant tubes 75 are coaxially screwed together, and are then installed in internal cavity 20. The pitch 97 of the fifth form 75 of the refrigerant tubes 70 is equal to about 3.6 to about 6 times the outside diametral dimension of the refrigerant tubes 70.

Referring still to FIGS. 3A-3H, the sixth form 76 of the refrigerant tubes 70 is seen in FIG. 3F. The sixth form 76 has an inside diametral dimension 99 which is sized so to telescopingly receive the fifth form 75 therein. In the present form of the invention, 3 right-handed 95 refrigerant tubes 70 of the fifth form 75 are coaxially screwed together, and are then installed in the internal cavity 20. The pitch 97 of the sixth form 76 is equal to about 3.6 to about 6 times the outside diametral dimension of the refrigerant tube 70. The seventh form 77, of the refrigerant tubes 70, is seen in FIG. 3G. The seventh form 77 has an inside diametral dimension 99 which is sized so as to telescopingly receive the sixth form 76 therein. In the present form of the invention, 4 left-handed 94 refrigerant tubes 70 of the seventh form 77 are coaxially screwed together, and are then installed in the internal cavity 20. The pitch 97 of the seventh form 77 is equal to about 4.8 to about 8 times the outside diametral dimension of the refrigerant tube 70. The eighth form 78 of the refrigerant tubes 70 is seen in FIG. 3H. The eighth form 78 has an inside diametral dimension 99 which is sized so as to telescopingly receive the seventh form 77 therein. In the present form of the invention 4 right-handed 95 refrigerant tubes 70 of the eighth form 78 are coaxially screwed together, and then installed in the internal cavity 20. The pitch 97 of the eighth form 78 is equal to about 4.8 to about 8 times the outside diametral dimension of the refrigerant tube 70.

As will be understood from the discussion, above, 23 refrigerant tubes 70, having eight different forms 71-78, and which are either left handed 94 or right handed 95 in orientation, and which further have different pitches 97, are utilized to form the closely nested refrigerant tube structure which is located within the internal cavity 20, and which further achieves the benefits of the invention 10, as described herein.

The respective refrigerant tubes 70, which are nested in the internal cavity 20, and in particular the first end 91, thereof, is individually coupled in fluid flowing relation relative to the first refrigerant distribution plate 51. As such, the main body 90 of each of the refrigerant tubes 70 are coupled in fluid receiving relation relative to a second source of refrigerant which is generally indicated by the numeral 110. The second source of the refrigerant 110 is a high pressure refrigerant having a pressure of about 90 PSI [A] to 750 PSI [A]. In one form of the invention 10, the second source of the refrigerant 110 condenses when the heat exchanger 10 is used in a cooling operation. Further, and in one form of the invention 10, this high pressure, second source of the refrigerant 110 is carbon dioxide. In addition to the foregoing, the second end 92 of each of the respective refrigerant tubes 70 are individually received in each of the multiplicity of spaced apertures 57, and which are formed in the second refrigerant collection plate 52. Therefore, it should be understood that the second source of refrigerant 110 moves along the fluid passageway 92A from the first end 91, to the second end 92, for the purposes which will be described, hereinafter. As stated above, the respective refrigerant tubes 70 each have a predetermined length dimension as measured between the first and second ends 91, and 92, and further individually form a helical coil 93 which has a given length dimension 96, and discrete pitch 97. In the arrangement as seen in the drawings (FIG. 3A-FIG. 3H, respectively), each of the refrigerant tubes 70, and the respective helical coils 93 that are formed by the individual refrigerant tubes 70 have the same overall length dimension. Stated somewhat differently, the overall length dimension of each of the refrigerant tubes as measured between the first end 91, and second end 92, and which is taken along the main body 90, thereof, is substantially identical. Further, the exterior length dimension 96 of the coil 93, is substantially identical. However, the pitch 97, and the inside and outside diametral dimensions 99, and 98, respectively, of the individual helical coils 93, which are defined by the several forms 71-78 vary, so that the respective forms of the refrigerant tubes 71 through 78, can be received and oriented in the closely nested, spaced relationship within the internal cavity 20 as seen in FIG. 2. This closely nested relationship facilitates a substantially uniform flow, and distribution of the first source of the refrigerant 65, once the first source of the refrigerant 65 leaves the refrigerant distribution tube 60, enters the internal cavity 20 of the exterior shell or container 11, and then vaporizes during a cooling operation. Once the refrigerant tubes 70 are appropriately nested within the internal cavity 20 it should be understood that the exterior container 11 will have a transverse cross-sectional flow area 111 which is defined between the refrigerant distribution tube 60, and the interior facing surface 15 of the exterior container. In the closely packed, and substantial uniformly spaced orientation, the helical coils 93 collectively occupy a preponderance of the space defined by the internal cavity 20, and further facilitates a flow velocity of the vaporized first refrigerant 65 within the transverse cross-sectional flow area 111 of less than about 50 feet per second. In the arrangement as seen in the drawings, the respective refrigerant tubes 70 impart a substantially similar pressure drop, and an equal flow of the condensing second source of the refrigerant 110 as the condensing refrigerant travels between the first and second ends 91 and 92 thereof, and when the heat exchanger 10 is being utilized in a cooling operation. In the present form of the invention, the respective refrigerant tubes 70, when exposed to different refrigerant pressures and temperatures, resiliently expand and contract in length. Upon expansion or contraction of the respective refrigerant tubes 70, the helical coil 93 construction of the respective refrigerant tubes 70 produces low physical strain and stress on the opposite ends 91 and 92, respectively, so as to impede an expansion or contraction induced fluid flowing separation of the opposite ends 91 and 92 of the respective refrigerant tubes 70 from either the refrigerant distribution plate 51, or refrigerant collection plate 52, respectively. This substantially prevents an accidental mixing of the first and second sources of refrigerant 65 and 110, respectively.

The present invention 10 is operable to utilize a second source of a high pressure refrigerant, and which is generally indicated by the numeral 110. The second source of the refrigerant which may include, for example, carbon dioxide, and which has a pressure of about 90 PSI[A] to about 750 PSI [A] is supplied to the first refrigerant delivery coupler 31 as earlier disclosed. The second source of high pressure refrigerant 110 as it enters the first refrigerant delivery coupler 31 at the first intake end 35 experiences a reduction in pressure as it moves between the first intake end 35, and the second exhaust end 36. The second source of refrigerant 110 then enters the first end 91 of each of the respective refrigerant tubes 70, and then travels to the second end 92 where it then enters the second refrigerant removal coupler 32. The second source of the refrigerant 110 is then utilized, again, for another refrigeration cycle.

As earlier discussed, the internal cavity 20 has a given cross-sectional flow area 111 which is defined between the refrigerant distribution tube 60, and the interior facing surface 15 of the exterior container 11. Further, the multiplicity of closely nested refrigerant tubes 70 are substantially equally spaced, one from the other, so as to provide a resulting cross-sectional flow area 111 which facilitates a flow velocity of the vaporized first refrigerant 65 within the transverse cross-sectional flow area 111 of less than 50 feet per second. The first refrigerant 65, upon exiting the second end 63 of the refrigerant distribution tube 60 forms a low pressure vapor which then moves vertically, upwardly and comes into heat conducting contact with each of the refrigerant tubes 70. The low pressure vapor 65 then escapes from the internal cavity 20 by way of a first fluid passageway which is generally indicated by the numeral 112, and which extends through the aperture 25 which is formed in the exterior container 11. The low pressure vapor 65 then is recycled or employed again in another refrigeration cycle. The present invention 10 further includes a second fluid passageway 113 which is located near the second end 13 of the exterior container 11 as seen in FIG. 2 and which passes through the aperture 24 which is formed in the exterior container 11. The second fluid passageway 113 operates, or is useful when the heat exchanger 10 is being employed in a defrosting or heating mode. In this regard, it should be understood that the first fluid passageway 112, which his located near the first end 12 of the exterior container 11, communicates in fluid flowing relation relative to the internal cavity 20 thereof; and the second fluid passageway 112 which is located near the opposite second end 13, also communicates with the internal cavity 20. The first fluid passageway 112, permits vapor formed of the first refrigerant 65 to escape from the internal cavity 20 of the exterior container 11 when the heat exchanger 10 is being utilized in a cooling operation. However, the first fluid passageway 112 further permits vapor derived from the first refrigerant 65 to enter the internal cavity 20 of the exterior container 11, and the second fluid passageway 113 permits a condensed liquid derived, at least in part, from the first refrigerant 65, to leave, or be removed from the internal cavity 20 when the heat exchanger 10 is being utilized in a heating or defrosting operation. As seen in FIG. 2 the first fluid passageway 112 is located elevationally above the second fluid passageway 113.

Operation

The operation of the described embodiments of the present invention are believed to be readily apparent, and are briefly summarized at this point.

In its broadest aspect the present invention relates to a heat exchanger 10 which finds particular usefulness in a cascade refrigeration system, and more specifically to a heat exchanger 10 which includes an exterior container 11, and which further defines an internal cavity 20. A refrigerant distribution tube 60 is positioned within the internal cavity 20, and is further coupled in fluid receiving relation relative to a first source of a refrigerant 65. In its broadest aspect, the heat exchanger 10 further includes a multiplicity of closely nested, and spaced refrigerant tubes 70 which are located within the internal cavity 20 of the exterior container 11, and which are further disposed in closely spaced, radially outwardly oriented positions relative to the refrigerant distribution tube 60. The respective refrigerant tubes 70 each have a predetermined, and similar length dimension (as measured from end to end); and individually form a helical coil 93 which has a given and similar length dimension 96, and a variable, or individually discrete pitch 97. The respective refrigerant tubes 70 are each coupled in fluid receiving relation relative to a second source of a refrigerant 110. In one possible form of the invention 10 as see in FIG. 2, 23 refrigerant tubes 70, and which comprise 8 different refrigerant tube forms 71-78, are nested together to form the structure as illustrated.

In its broadest aspect, the present invention 10 includes, as noted above, a first source of a refrigerant 65 which is a low pressure refrigerant; and a second source of refrigerant 110 which is considered a high pressure refrigerant. In this regard, the first source of the refrigerant 65 is a low pressure refrigerant which evaporates or vaporizes when the heat exchanger 10 is used in a cooling operation; and the second source of the refrigerant 110 is a high pressure refrigerant which condenses when the heat exchanger 10 is used in a cooling operation. On the other hand, the first source of the refrigerant 65 may condense when the heat exchanger 10 is used in the heating or defrosting operation, and the second source of the refrigerant 110 may evaporate when the heat exchanger is used in the same heating or defrosting operation.

The present invention 10 includes, as noted above, an exterior container 11 which has opposite ends 12 and 13, and wherein a refrigerant distribution plate 51 is sealably mounted on one end 12 of the exterior container. Each of the refrigerant tubes 70, as noted above, have a first end 91 which are individually coupled in fluid receiving relation relative to the refrigerant distribution plate 51. The refrigerant distribution plate is coupled in fluid receiving relation relative to the second source of the refrigerant 110. A refrigerant collection plate 52 is sealably mounted on the opposite end 13 of the exterior container 11. Each of the refrigerant tubes 70 have a second end 92, and which are individually coupled in a fluid discharging relation relative to the refrigerant collection plate 52. It should be understood that the refrigerant distribution plate 51, and refrigerant collection plate 52 each have a multiplicity of symmetrically spaced apertures 57 which are formed therein. The symmetrically spaced apertures are individually sized so as to matingly and fluid flowingly couple with one of the first or second ends 91 or 92 of the respective refrigerant tubes 70. The refrigerant collection and distribution plates 51 and 52, acting in combination, orient at least in part the respective refrigerant tubes 70 in nested, equally spaced positions one relative to the other, and within the internal cavity 20 of the exterior container 11, so as to facilitate a substantially uniform flow and distribution of the vaporized, first source of refrigerant 65, once the first source of the refrigerant 65 leaves the refrigerant distribution tube 60, enters the internal cavity 20 of the exterior container 11, and then vaporizes during a cooling operation.

It should be understood by a study of FIG. 2 that a transverse cross-sectional flow area 111 is defined within the internal cavity 20 of the exterior container 11 when the multiplicity of nested, closely spaced refrigerant tubes 70 are received within the internal cavity 20. The respective refrigerant tubes 70 have an overall length dimension, when measured between the opposite ends 91 and 92, and along the main body 90, which are substantially equal. The transverse cross-sectional flow area 111 facilitates or permits a flow velocity of the vaporized, first refrigerant 65 within the transverse cross-sectional flow area 111 of less than about 50 feet per second. In the arrangement as seen in the drawings, the exterior container 11 further has a longitudinal axis 16, and the respective refrigerant tubes 70 which form each of the helical coils 93 are each coaxially oriented relative to the longitudinal axis 16 of the exterior container 11. The exterior container 11 has a length dimension as measured between the first and second ends 12 and 13, and further the respective helical coils 93 which are defined, at least in part, by the main body 90, of each of the refrigerant tubes 70, has a length dimension 96, which is less than the length dimension of the exterior container 11. Each helical coil 93 has the same length dimension 96. The exterior container 11 further includes or defines a first fluid passageway 112 which is located near one end 12 of the exterior container, and which communicates in fluid flowing relation relative to the internal cavity 20 thereof. The exterior container 11 further defines a second fluid passageway 113 which is located near the opposite end 13 of the exterior container 11, and further communicates in fluid flowing relation relative to the internal cavity 20. The first fluid passageway 112 permits vapor formed of the first refrigerant 65 to escape from the internal cavity 20 of the exterior container 11 when the heat exchanger 10 is being utilized in a cooling operation. On the other hand, the first fluid passageway 112 permits vapor formed of the first refrigerant 65 to enter the internal cavity 20 of the exterior container, and the second fluid passageway 130 permits a liquid which is derived, at least in part, from the first refrigerant 65, to leave the internal cavity 20, which is further defined by the exterior container 11, when the heat exchanger 10 is being utilized in a heating or defrosting operation. The first fluid passageway 112 is located elevationally above the second fluid passageway 113.

In the arrangement as seen in the drawings it should be understood that the respective refrigerant tubes 70 impart a substantially similar pressure drop, and an equal flow of the condensing refrigerant 110 as the condensing, second source of refrigerant 110 travels between the first and second ends 91 and 92 of the respective refrigerant tubes 70 when the heat exchanger 10 is being utilized in a cooling operation. In one possible form of the invention the first refrigerant 65 comprises ammonia, and the second source of refrigerant comprises carbon dioxide. The respective refrigerant tubes 70, when exposed to changes in refrigerant pressure, and temperature are individually operable to resiliently expand and contract in length in view of the presence of the helical coil 93. Upon expansion or contraction of the respective refrigerant tubes 70, the helical coil construction 93 of each of the respective refrigerant tubes 70 produces or facilitates, at least in part, a relatively low physical strain and stress on the opposite ends 91 and 92, thereof, so as to impede the development of an expansion or contraction induced fluid-flowing separation of the opposite ends 91 and 92 of the refrigerant tubes 70 from either the refrigerant distribution plate 51 and/or the refrigerant collection plate 52, respectively. This operational aspect of the invention prevents an accidental or inadvertent mixing of the first and second sources of the refrigerant 65 and 110, respectively. The respective refrigerant tubes 70, as described herein, each form a helical coil 93 having a given bend radii. The bend radii of the respective helical coils 93, which are formed by the individual refrigerant tubes 70, increases when the bend radii of each of the refrigerant tube 71-78 is measured along a line which extends radially, outwardly, from the refrigerant distribution tube 60, and towards the exterior container 11. Each helical coil 93 which is defined by the individual refrigerant tubes 70 defines a predetermined outside coil diameter 98. The respective helical coils 93 which are defined by the respective refrigerant tube 70 are either left handed 94, or right handed 95 in orientation. The respective refrigerant tubes 70 each have an outside diametral dimension 98, and the respective helical coils 93 are substantially equally, and symmetrically spaced from an adjacent helical coil 93 which is defined by a refrigerant tube 70, when the respective helical coils 93 are nested together, and located within the internal cavity 20 of the container 11 as seen in FIG. 2. Each form 71-78 of the refrigerant tubes 70 define, at least in part, a helical coil 93 which has a predetermined pitch 97. When appropriately nested together, and located within the internal cavity 20, the respective refrigerant tubes 70 are spaced from adjacent refrigerant tubes 70 by a distance of about 1.2 to about 2.0 times the outside diametral dimension of the respective refrigerant tubes 70.

Therefore it will be seen that the present heat exchanger 10 provides many advantages over the prior art heat exchangers which have been utilized, heretofore, in cascade-type refrigeration systems. The present heat exchanger 10 is robust, compact, and can be scaled to various sizes, and is further designed so as to prohibit expansion and contraction related damage that might be occasioned by changes in refrigerant temperatures and pressures. The present invention's compact design further facilitates many advantages in the design and operation of cascade refrigeration systems which have not been possible, heretofore.

In compliance with the statute the invention has been described in language more or less specific as to structural and methodical features. It is to be understood, however, that the invention is not limited to the specific features shown and described since the means herein disclosed comprise preferred forms of putting the invention into effect. The invention is, therefore, claimed in any of its forms or modifications when the proper scope of the appended claims appropriately interpreted according with the Doctrine of Equivalence.

We claim:

1. A heat exchanger, comprising:

an exterior container which has opposite first and second ends, and defines an internal cavity, and wherein the exterior container is further defined by a longitudinal axis that extends between the opposite first and second ends;

a refrigerant distribution tube which is positioned within the internal cavity of the exterior container, and is oriented along the longitudinal axis thereof, and wherein the refrigerant distribution tube has a first refrigerant intake end which is located within the internal cavity, and in spaced relation relative to the first end of the exterior container, and a second refrigerant exhaust end, and wherein the second refrigerant exhaust end is located within the internal cavity, and in spaced relation relative to the second end of the exterior container, and wherein the first end of the refrigerant distribution tube is fluid flowingly coupled to a source of a first refrigerant; and a multiplicity of refrigerant tubes within the internal cavity of the exterior container and each of the multiplicity of refrigerant tubes has a length dimension, and wherein each of the multiplicity of refrigerant tubes are equal in length, and wherein each of the multiplicity of refrigerant tubes further defines a helically shaped coil having a coil length, and wherein each helical coil is equal in length, and wherein the multiplicity of refrigerant tubes are further individually located in a radially outwardly spaced relationship relative to the longitudinal axis of the exterior container, and wherein the respective helical coils defined by each of the multiplicity of refrigerant tubes are either left hand, or right handed in orientation, and are further helically nested together, in both a longitudinal and a radially outward direction, so as to orient the respective multiplicity of refrigerant tubes in a predetermined, closely spaced helical relationship which occupies a majority of a volume of the internal cavity of the exterior container, and wherein the respective multiplicity of refrigerant tubes each have a first intake end, and a second exhaust end, and wherein the first end of each of the multiplicity of refrigerant tubes are further fluid flowing coupled to a second source of a refrigerant, and the second end of each of the multiplicity of the refrigerant tubes is disposed in fluid flowing communication with the second end of the external container.

2. A heat exchanger as claimed in claim 1, and further comprising:

a refrigerant distribution plate which is sealably mounted on the first end of the exterior container, and wherein the first end of each of the helical coil shaped refrigerant tubes are sealably coupled in fluid receiving relation relative to the refrigerant distribution plate, and the refrigerant distribution plate is coupled in fluid receiving relation relative to the second source of the refrigerant; and a refrigerant collection plate which is sealably mounted on the second end of the exterior container, and wherein the second end of each of the helical coil shaped refrigerant tubes are sealably coupled in fluid discharging relation relative to the refrigerant collection plate.

3. A heat exchanger as claimed in claim 1, and wherein the respective refrigerant tubes when helically nested together are spaced from adjacent refrigerant tubes at a distance which lies in a range of about 1.2 to about 2 times the outside diametral dimension of the respective refrigerant tubes.

4. A heat exchange as claimed in claim 1, and wherein the first source of the refrigerant is a low pressure refrigerant having a pressure of about 5 PSI[A] to about 315 PSI[A] which evaporates when the heat exchanger is used in a cooling operation, and the second source of the refrigerant is a high pressure refrigerant having a pressure of about 90 PSI[A] to about 750 PSI[A] which condenses when the heat exchanger is used in a cooling operation.

5. A heat exchanger as claimed in claim 4, and wherein the low pressure refrigerant comprises ammonia, and the high pressure refrigerant is carbon dioxide.

6. A heat exchanger as claimed in claim 1, and wherein the respective refrigerant tubes impart a substantially similar pressure drop, and an equal flow path of the second source of the refrigerant as the refrigerant travels between the first and second ends thereof.

7. A heat exchanger as claimed in claim 1, and wherein the respective refrigerant tubes each have a predetermined helical coil diameter, and are either left-handed or right-handed in orientation, and wherein at least some of the helical coils located within the internal cavity are juxtaposed relative to other helical coils which have an opposite coil orientation.

* * * * *